US009483025B2

(12) United States Patent
Stark

(10) Patent No.: US 9,483,025 B2
(45) Date of Patent: Nov. 1, 2016

(54) WATCH WITH MULTI-COLOURED COMPONENTS

(71) Applicant: ETA SA MANUFACTURE HORLOGÈRE SUISSE, Grenchen (CH)

(72) Inventor: Stefan Stark, Preles (CH)

(73) Assignee: ETA SA MANUFACTURING HORLOGÉRE SUISSE, Grenchen (CH)

( * ) Notice: Subject to any disclaimer, the term of this patent is extended or adjusted under 35 U.S.C. 154(b) by 0 days.

(21) Appl. No.: 13/861,915

(22) Filed: Apr. 12, 2013

(65) Prior Publication Data

US 2013/0272102 A1 Oct. 17, 2013

Related U.S. Application Data

(60) Provisional application No. 61/623,921, filed on Apr. 13, 2012.

(51) Int. Cl.
*G04B 45/00* (2006.01)

(52) U.S. Cl.
CPC ..... *G04B 45/0076* (2013.01); *Y10T 29/49579* (2015.01); *Y10T 29/49584* (2015.01)

(58) Field of Classification Search
CPC ..... G04B 37/22; G04B 45/0076; Y10T 29/49584; Y10T 29/49579
USPC ..... 368/238
See application file for complete search history.

(56) References Cited

U.S. PATENT DOCUMENTS 4,885,731 A * 12/1989 Massaro ..... 368/228
5,134,387 A * 7/1992 Smith ..... G09F 9/33 345/692
5,636,185 A * 6/1997 Brewer ..... G04B 45/0015 349/165
6,039,574 A * 3/2000 Standiford et al. ..... 434/304
6,618,327 B2 * 9/2003 Brewer et al. ..... 368/84
6,831,880 B1 * 12/2004 Ziegler ..... 368/223
8,021,223 B2 * 9/2011 Rose ..... 463/16

OTHER PUBLICATIONS

Random—dictionary.com; Apr. 16, 2014.*
TimeArt—chronoart.com; Apr. 16, 2014.*
25 Cool and Unusual Clocks—boredpand.com; Apr. 16, 2014.*
Kaleidoscope—amazon.com; Apr. 16, 2014.*
Wooden Shape Sorting Clock—melissaanddoug.com—Nov. 10, 2010.*

* cited by examiner

*Primary Examiner* — Sean Kayes
(74) *Attorney, Agent, or Firm* — Sughrue Mion, PLLC

(57) ABSTRACT

Method for forming an assembly of elementary timepiece components, each available in different colored variants, wherein at least some of said different elementary components are the same color as each other, characterized in that a random selection of each said elementary component is made until said complete assembly is obtained, so that at least two elementary components are of different colors.

16 Claims, 1 Drawing Sheet

Fig. 1
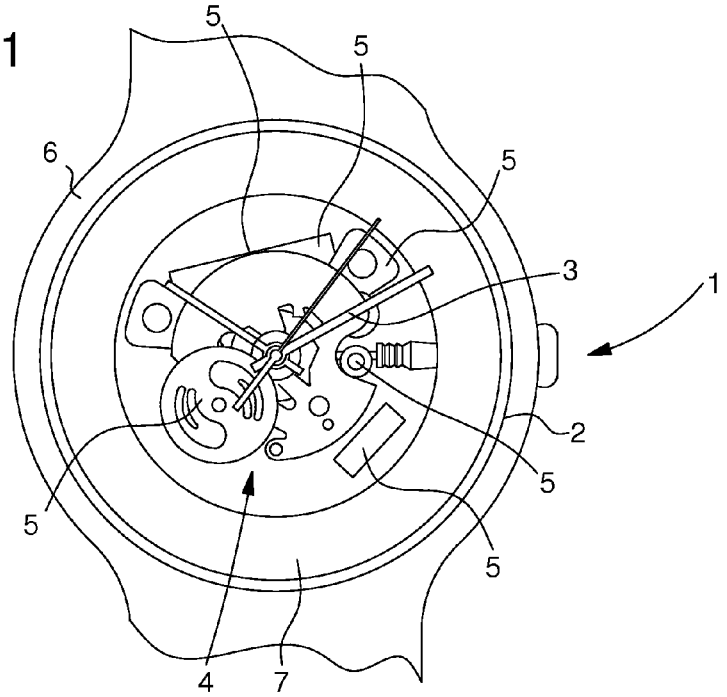
Fig. 2
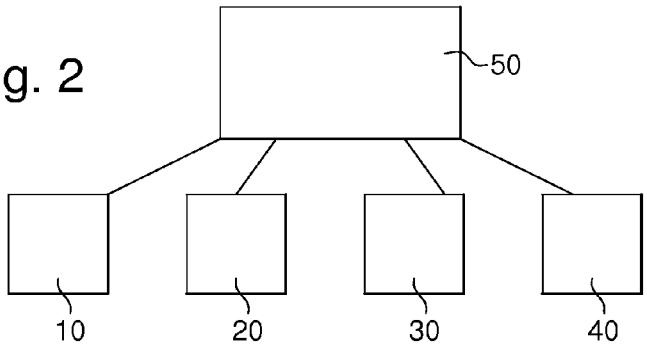
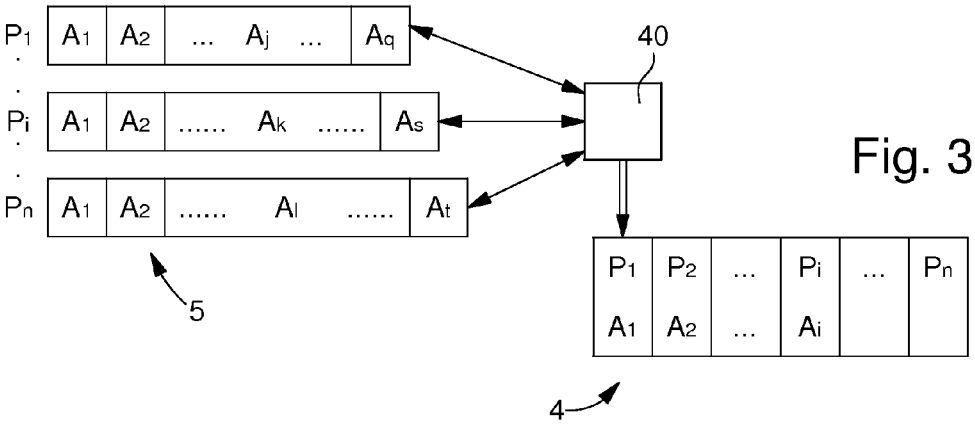
Fig. 3

WATCH WITH MULTI-COLOURED COMPONENTS

FIELD OF THE INVENTION

The invention concerns a method for forming an assembly of elementary timepiece components, each available in different coloured variants, wherein at least some of said different elementary components are the same colour as each other. The invention further concerns a method for assembling a timepiece assembly in a given parts list.

The invention further concerns a method for assembling a watch comprising at least a case, a set of hands, and at least one timepiece assembly in a given parts list, including elementary components, each available in different coloured variants, wherein at least some variants of some of said different elementary components are the same colour as each other.

The invention further concerns a watch comprising at least a case, a set of hands and at least one timepiece assembly in a given parts list and comprising elementary components each available in different coloured variants, wherein at least some variants of said different elementary components are the same colour as each other.

BACKGROUND OF THE INVENTION

In order to obtain a large variety of components, from batches of components available with different looks, it is common to make particular manufacturing batches in set compositions, which has the drawback of placing on the market at a given time similar products which are indistinguishable from each other.

SUMMARY OF THE INVENTION

The invention proposes to set in place an industrial method for producing multi-coloured watches from components which are each available in several colours or with different looks, so as to create a randomly produced population which does not appear mass produced, and a great variety in the finished products obtained.

The invention therefore concerns a method for forming an assembly of elementary timepiece components, each available in different coloured variants, wherein at least some of said different elementary components are the same colour as each other, characterized in that a random selection is made of each said elementary component until said complete assembly is obtained, so that at least two elementary components are a different colour.

The invention further includes a method for assembling a timepiece assembly in a given parts list, characterized in that a pre-assembly of said timepiece assembly is formed by this type of forming method, and characterized in that said elementary components of said timepiece assembly are mounted in position in a required order.

The invention further concerns a method for assembling a watch comprising at least a case, a set of hands and at least one timepiece assembly in a given parts list, including elementary components each available in different coloured variants, wherein at least some variants of some of said different elementary components are the same colour as each other, characterized in that said at least one timepiece assembly is mounted on said case according to said assembly method, and in that said set of hands is then mounted on said assembled timepiece assembly.

The invention further concerns a watch including at least a case, a set of hands, and at least one timepiece assembly in a given parts list and including elementary components each available in different coloured variants, wherein at least some variants of some said different elementary components are the same colour as each other, characterized in that said case and said set of hands are each a determined colour, and in that all of the colours of all of said elementary components of said at least one timepiece assembly are different, on the one hand from each other, and on the other hand from said determined colours of said case and said set of hands.

BRIEF DESCRIPTION OF THE DRAWINGS

Other features and advantages of the invention will appear upon reading the following detailed description, with reference to the annexed drawings, in which:

FIG. 1 shows a schematic front view of a watch including at least a case, a set of hands and at least one timepiece assembly in a given parts list and including elementary components.

FIG. 2 shows a schematic view of a control means coordinating a colour recognition means for identifying the colour of each said selected component, storage means for storing the colour of each said selected component, comparison means and an automated manipulator means.

FIG. 3 shows a schematic view of batches of different coloured elementary components, from which components are selected to form a timepiece assembly.

DETAILED DESCRIPTION OF PREFERRED EMBODIMENTS

The invention proposes to set in place an industrial method for producing multi-coloured watches from components which are each available in several colours or with different looks, so as to create a randomly produced population which does not appear mass produced, and a great variety in the finished products obtained.

"Colour" in the present invention means a particular look, which may be a colour in the usual sense, or which may be linked to the nature of the material, or to a heat and/or surface treatment applied thereto.

The invention concerns a method for forming an assembly 4 of elementary timepiece components 5, each available in different coloured variants, wherein at least some of said different elementary components 5 are the same colour as each other, characterized in that a random selection is made of each said elementary component 5 until said complete assembly 4 is obtained, so that at least two elementary components 5 are a different colour.

According to an alternative implementation of the method, a random selection is made of each said elementary component 5 until said complete assembly 4 is obtained, so that all of the colours of all of said elementary components 5 are different from each other.

According to an alternative implementation of this method:

- from among these components 5, a first said component P1 is randomly selected from the population of said colour variants in which said component is available, and the first colour A1 thus selected is stored for said first component P1;
- a second said component P2 is randomly selected from among the population of said colour variants in which said component is available, with the exception of said first colour A1 selected for said first component P1 and the second colour A2 thereby selected for said second component P2 is stored;

until said total number N of said components Pi is reached, a selection of each other component Pi is made in succession, each from the remaining population of variants whose colour has not already been selected, and the other colour Ai thus selected for said other component Pi is stored;

the process of forming said assembly stops when the composition is complete.

According to an alternative implementation of this method, in order to select another said component 5 from the remaining population of variants whose colour has not already been selected, the following are used:

colour recognition means 10 for identifying the colour of each said selected component, storage means 20 for storing the colour of each said selected component, comparison means 30 for comparing the colour of each said selected component to the colours of the previously selected components, to check whether it is different, and to reject it if it is identical to one of said colours, in which case another variant of said other component of the same type is selected, which is subjected to the same comparison test, until a different colour is obtained from the colours of the previously selected components.

According to an alternative implementation of this method, said rejection is performed by redepositing said selected component into a population of the same variant of the same colour as that from which said component was removed.

According to an alternative implementation of this method, at least one automated manipulator 40 is used by control means 50 for selecting each said component of said assembly in a population of the same variant of the same colour, from among several populations each corresponding to a different coloured variant of said same component.

According to an alternative implementation of this method, said control means 50 also controls:

colour recognition means 10 for identifying the colour of each said selected component, storage means 20 for storing the colour of each said selected component, comparison means 30 for comparing the colour of each said selected component to the colours of the previously selected components, to check whether it is different, and to reject it if it is identical to one of said colours, in which case another variant of said other component of the same type is selected, which is subjected to the same comparison test, until a different colour is obtained from the colours of the previously selected components.

According to an alternative implementation of the method, said control means 50 includes random control means for randomly removing at least one random variant of said random elementary component.

According to an alternative implementation of this method, said control means 50 includes random control means for randomly removing at least one random variant of said random first elementary component, and completes said composition of said assembly 4 by randomly selecting each said variant of each said elementary component.

According to an alternative implementation of this method, said control means 50 simulates beforehand or in real time the selection of said variants of said elementary components, so as to control simultaneous selections by several automated manipulators 40.

According to an alternative implementation of this method, said control means 50 controls the selection of said variants of said components in a random order.

According to an alternative implementation of this method, said control means 50 controls the selection of said variants of said components in a required order.

The invention further includes a method for assembling a timepiece assembly in a given parts list structure, characterized in that a pre-assembly of said timepiece assembly is formed in accordance with this forming method, and characterized in that said elementary components of said timepiece assembly are mounted in position in a required order.

According to an alternative implementation of this method, at least one automated manipulator 40 is used for selecting each said elementary component 5, and said manipulator also mounts said component 5 in position on a structure 7 comprised in said timepiece assembly 4, either directly or indirectly by assembly on at least one of said other components 5.

According to an alternative implementation of this method, the mounting in position of at least one said elementary component 5 is carried out with a delay relative to the selection thereof.

The invention also concerns a method for assembling a watch 1 comprising at least one case 2, a set of hands 3, and at least one timepiece assembly 4 in a given parts list, including elementary elements 5, each available in different coloured variants, wherein at least some variants of some said different elementary components are the same colour as each other, characterized in that said at least one timepiece assembly 4 is mounted on said case 2 in accordance with said assembly method and in that said set of hands 3 is then mounted on said assembled timepiece assembly 4.

According to an alternative implementation of this method, said case 2 and said set of hands 3 are each selected in a determined colour, and when said at least one timepiece assembly 4 is formed in accordance with the forming method, it is prohibited to select any variant of any component in said determined colour of said case 2 or said set of hands 3.

The invention further concerns a watch comprising at least a case 2, a set of hands 3 and at least one timepiece assembly 4 in a given parts list and comprising elementary components 5 each available in different coloured variants, wherein at least some variants of said different elementary components are the same colour as each other.

According to the invention, said case 2 and said set of hands 3 are each a determined colour, and all of the colours of all of said elementary components 5 of said at least one timepiece assembly 4 are different, on the one hand from each other, and on the other hand from said determined colours of said case 2 and said set of hands 3.

According to a particular feature, this case 2 and set of hands 3 are the same said determined colour.

In a variant, watch 1 also includes a bracelet or wristband 6, the colour of which may, like that of case 2 and set of hands 3, be imposed. Preferably, said bracelet 6, case 2 and set of hands 3 are the same said determined colour.

What is claimed is:

1. A method of assembling a watch, the watch comprising a case, a set of hands, and a multi-colored assembly, the multi-colored assembly comprising a plurality of elementary timepiece components, and each component among the plurality of elementary timepiece components is available in a plurality of colored variants, the method comprising:

successively selecting a colored variant of each component among the plurality of elementary timepiece components until every component among the plurality of elementary timepiece components is selected;

comparing a color of a first selected component among the plurality of selected components with a color of a second selected component among the plurality of selected components, and replacing, if the color of the first selected component and the color of the second selected component is the same, the second selected component with a different color-variant of a same component among the plurality of elementary timepiece components; and assembling the watch, wherein the successively selectin comprises, for each currently selected component among the successively selected components:

identifying a color of the currently selected component;

comparing the color of the currently selected component with a color of each previously selected component among the successively selected components; and rejecting, in response to the color of the currently selected component being the same as a color of any component among the previously selected components, the currently selected component and selecting a different colored variant a same component as the currently selected component to be the currently selected component, wherein the identifying, comparing, and selecting is performed until a color of each selected component among the plurality of selected components is different from a color of every other selected component among the plurality of selected components, wherein the method further comprises storing, in a store for storing colors of elementary timepiece components, the color of the currently selected component and the color of each previously selected components, wherein the identifying a color of the currently selected component is performed by a color recognition means, and wherein the comparing the color of the currently selected component is performed by a comparison means used to compare the color of the currently timepiece component with the color of each previously selected component stored in the storage.

2. The method of assembling a watch according to claim 1, wherein a color of each selected component among the plurality of selected components is different from every other selected component among the plurality of a selected components.

3. The method according to claim 1, wherein the assembling the watch comprises:

assembling the multi-colored assembly by mounting the selected components on the case at predetermined positions and in an order; and mounting the set of hands on said multi-colored assembly.

4. The method according to claim 1, further comprising:

selecting the case and the set of hands in a determined color; and successively selecting each elementary timepiece component to have a color different from the determined color.

5. The method of assembling a watch according to claim 1, wherein the rejecting the currently selected component comprises redepositing the rejected component into a population of same colored variant as that from which the rejected component was selected.

6. The method according to claim 1, wherein the successively selecting comprises an automated manipulator successively selecting a colored variant of each elementary timepiece from a population of same colored variant elementary timepiece components from among several populations of same components of different colored variants.

7. The method according to claim 1, wherein a controller controls said storage, color recognition means, and the comparison means.

8. The method according to claim 7, wherein said controller controls the selection of said variants of said components in a predetermined order.

9. A method of selecting a plurality of elementary timepiece components of a multi-colored assembly, each component among the plurality of elementary timepiece components having a plurality of colored variant, the method comprising:

selecting a first component among the plurality of elementary timepiece components;

storing a color for the first component in a storage for storing colors of elementary timepiece components; and successively selecting next components among the plurality of elementary timepiece components until each component among the plurality of elementary timepiece components is selected, wherein the successively selecting each next component comprises:

identifying, by a color recognition means, a color of the next component;

comparing, by a comparison means, the color of the selected next component with a color of each previously selected component stored in the storage;

rejecting, in response to the color of the selected next component being the same as a color of any previously selected component stored in the storage, the selected next component and selecting a different colored variant of the next component as the selected next component; and storing, in the storage the color of the selected next component with the color of each previously selected components, wherein a color of the first component and of each successive next component is selected psuedo-randomly, and wherein the identifying, comparing, and rejecting is performed until a color of each selected component among the plurality of selected components is different from a color of every other selected component among the plurality of selected components.

10. The method according to claim 9, wherein the selecting the first component further comprises storing a color of the first component, and wherein the successively selecting each next component further comprises:

selecting the next component from populations of a same type as the type of the next component having a color that is different from the stored colors of each previously selected component.

11. The method according to claim 9, wherein the components of the multi-colored assembly are selected in a predetermined order.

12. The method according to claim 9, wherein the selecting the first component comprises selecting a component from among a plurality of populations of components having a same type, components of each population having a same type and color, and wherein the successively selecting each next component further comprises:

selecting the next component from among a plurality of populations of components having a same type as the next component, components of each population having a same type and color.

13. The method according to claim 12, wherein the successively selecting each next component further comprises:

selecting the next component from among the plurality of populations of components having the same type as the next component and a color that is different from the stored colors of each previously selected component.

14. The method according to claim 9, wherein the first component is selected pseudo-randomly, and wherein the next components are selected in a pseudo-random order.

15. The method according to claim 9, wherein a color of the first component is determined prior to selection, wherein the selecting the first component comprises selecting a component from a population of components a same type and a same color as the determined color of the first component, wherein a respective color of each next component is determined prior to selection, and wherein the successively selecting each next component further comprises selecting the next component from a population of components having a same type as the next component and a same color as the determined respective color.

16. A method of selecting a plurality of elementary timepiece components of a multi-colored assembly, each component among the plurality of elementary timepiece components being available in a plurality of colors, and each component among the plurality of elementary timepiece components having a type, the method comprising:

successively determining, psuedo-randomly, a color for each component among the plurality of elementary timepiece components until a color for every component among the plurality of elementary timepiece components being determined; and selecting each component according to the type of the component and the respective determined color, wherein the successively determining comprises, for each currently determined color of a current component among the plurality of elementary timepiece components is determined:

selecting a color of the current component;

comparing, by a comparison means, the selected color of the current component with a color of each previously determined color stored in a storage for storing colors of elementary timepiece components;

rejecting, in response to the selected color of the current component being the same as any previously determined color, the selected color and selecting a different color of the current component as the currently determined color; and storing, in the storage, in response to the selected color of the current component being different from all previously determined colors, the selected color as the determined color, and wherein the selecting the color, comparing, and rejecting is performed until a determined color for each component among the plurality of elementary timepiece components is different from a determined color of every other component among the plurality of elementary timepiece components.

* * * * *